US005297829A

United States Patent [19]

Richardson

[11] Patent Number: 5,297,829

[45] Date of Patent: Mar. 29, 1994

[54] SECURITY LOCK FOR DOOR

[76] Inventor: Stanley G. Richardson, 504 Barton Street East, Unit 32, Stoney Creek, Ontario, Canada, L8E 2L6

[21] Appl. No.: 974,771

[22] Filed: Nov. 12, 1992

[51] Int. Cl.[5] ..... E05C 19/18

[52] U.S. Cl. ..... 292/289; 292/296; 292/298; 70/14

[58] Field of Search ..... 292/288-298; 70/14

[56] References Cited

U.S. PATENT DOCUMENTS

| | | | |
|---|---|---|---|
| 672,473 | 4/1901 | Brooks | 292/298 |
| 792,966 | 6/1905 | Coleman et al. | 292/296 |
| 848,817 | 4/1907 | Fleming | 292/296 |
| 910,431 | 1/1909 | Stoffel | 292/296 |
| 1,178,504 | 4/1916 | Edwards | 292/297 |
| 1,406,085 | 2/1922 | Rouch et al. | 292/297 |
| 1,676,335 | 7/1928 | Knight | 292/296 |
| 1,971,440 | 8/1934 | Aubertin | 292/289 X |
| 2,128,479 | 8/1938 | Taylor | 292/298 |
| 4,169,619 | 10/1979 | McCracken | 292/296 X |
| 4,471,981 | 9/1984 | Wright . | |
| 4,575,140 | 3/1986 | Dargis | 292/289 X |

FOREIGN PATENT DOCUMENTS

| | | | |
|---|---|---|---|
| 336542 | 5/1921 | Fed. Rep. of Germany | 292/289 |
| 21904 | of 1905 | United Kingdom | 292/296 |
| 2230293 | 10/1990 | United Kingdom | 292/289 |

*Primary Examiner*—Peter M. Cuomo
*Assistant Examiner*—Suzanne L. Dino
*Attorney, Agent, or Firm*—Moss, Barrigar & Oyen

[57] ABSTRACT

A security lock for a door used to open and close an opening defined by a door frame, the door having a reciprocable bolt movable into and out of a hole in the door frame. The lock comprises an elongate lock member having a flat end section with a central opening at one end of the lock member and a shank portion at the opposite end thereof. The flat end section is insertable between an edge of the door and the door frame. A hook element is connected to this end section and is located adjacent the central opening so as to project into the hole in the door frame during use of the lock. An integral tongue element has one end thereof connected to the shank portion and has a door engaging portion biased by spring action to move from a first position where the door can be opened or closed to a second position where the door is blocked and prevented from opening. Preferably the lock is made from spring steel.

19 Claims, 5 Drawing Sheets

SECURITY LOCK FOR DOOR

SUMMARY OF THE INVENTION

This invention relates to security locks and, in particular, locks designed for use with a door used to open and close an opening defined by a door frame, the door having a reciprocable bolt movable into and out of a hole in the door frame.

Various forms of security locks are known and are readily available. For example, the use of padlocks which either require a key to be opened or which have a dial for a secret combination to be entered are commonly used but such padlocks are not suitable for all applications and they can have disadvantages. For example, if a security lock is operated by a key, there is the hazard of the key being lost. In the case of a combination lock, the combination may be forgotten by the owner of the lock. Furthermore, a padlock can only be used where the door or other member to be locked is equipped with a suitable latch mechanism or hasp. Also, many locking devices may not be suitable for only temporary use on a door.

U.S. Pat. No. 4,471,981 issued Sep. 18, 1984 to Thomas E. Wright teaches a security lock that can be used to temporarily lock a standard door that is mounted in a door opening having a door frame. This lock comprises two principal members, one being a locking bar having a flat end section with a central opening. Extending from this opening is a hook end adapted to engage the striker plate depression in the door frame. The locking bar has a notched shank portion on which is adjustably mounted a lock piece or fastener. The position of this fastener can be adjusted on the shank in order to hold the door in the closed position. One difficulty with this type of lock is that it requires two principal components, both of which would appear to require several manufacturing steps and thus the complete lock would be reasonably expensive to build. This lock may also be relatively time consuming in its use as it requires some manoeuvering and adjusting to place it in the proper position for locking of the door.

It is an object of the present invention to provide a relatively simple security lock suitable for locking a standard door in a building, which lock can be constructed or made at a very reasonable cost.

It is a further object of the invention to provide a security lock that is quite simple to use and requires very little time to be mounted between a door and a door frame.

SUMMARY OF THE INVENTION

According to one aspect of the invention, there is provided a security lock for a door used to open and close an opening defined by a door frame, the door having a reciprocal bolt movable into and out of a hole in the door frame. The lock comprises an elongate lock member having a flat end section with a central opening at one end of the lock member and a shank portion at the opposite end thereof. The flat end section is insertable between an edge of the door and the door frame with the shank portion projecting outwardly from one side of the door. A rigid hook element is connected to the flat end section and is located adjacent the central opening so a to project into the hole in the door frame during use of the lock. The hook element extends substantially at an acute angle to the plane of the flat end section and towards the opposite end of the lock member. An integral tongue element has one end thereof connected to the shank portion. This tongue element has a door engaging portion biased by spring action of the tongue element to move from a first position where the door can be opened or closed to a second position where the door is blocked and prevented from opening.

Preferably the tongue element includes a resilient stem portion integrally connected at one end thereof to the shank portion. The stem portion may be positioned in an elongate opening formed centrally in the shank portion. The stem portion is preferably curved along its length and is connected at its distal end to the door engaging portion, the latter portion extending generally in a transverse direction relative to the flat end section.

According to another aspect of the invention, a lock comprises a lock member having a flat end section with an opening therein at one end and a shank portion at the opposite end thereof. The flat end section is insertable between one edge of the door and the door frame. Means are provided for holding the flat end section between the door edge and the door frame when the door is closed. This hook element is connected to the flat end section and located adjacent the opening. The hook element extends substantially at an acute angle to the plane of the flat end section and towards the opposite end of the lock member. There is also a resilient door engaging member mounted on portion and biased to move from a first position where the door can be opened or closed to a second position where the door is blocked and prevented from opening.

In a preferred embodiment, the lock member is formed from a single piece of spring steel.

In another embodiment of the invention, the shank portion of the lock member is resilient and the door engaging portion of the tongue element is biased by spring action of the shank portion towards the position where the door is blocked and prevented from opening.

Further features and advantageous will become apparent from the following detailed description taken in conjunction with the accompanying drawings.

DETAILED DESCRIPTION OF PREFERRED EMBODIMENTS

Figure 1:
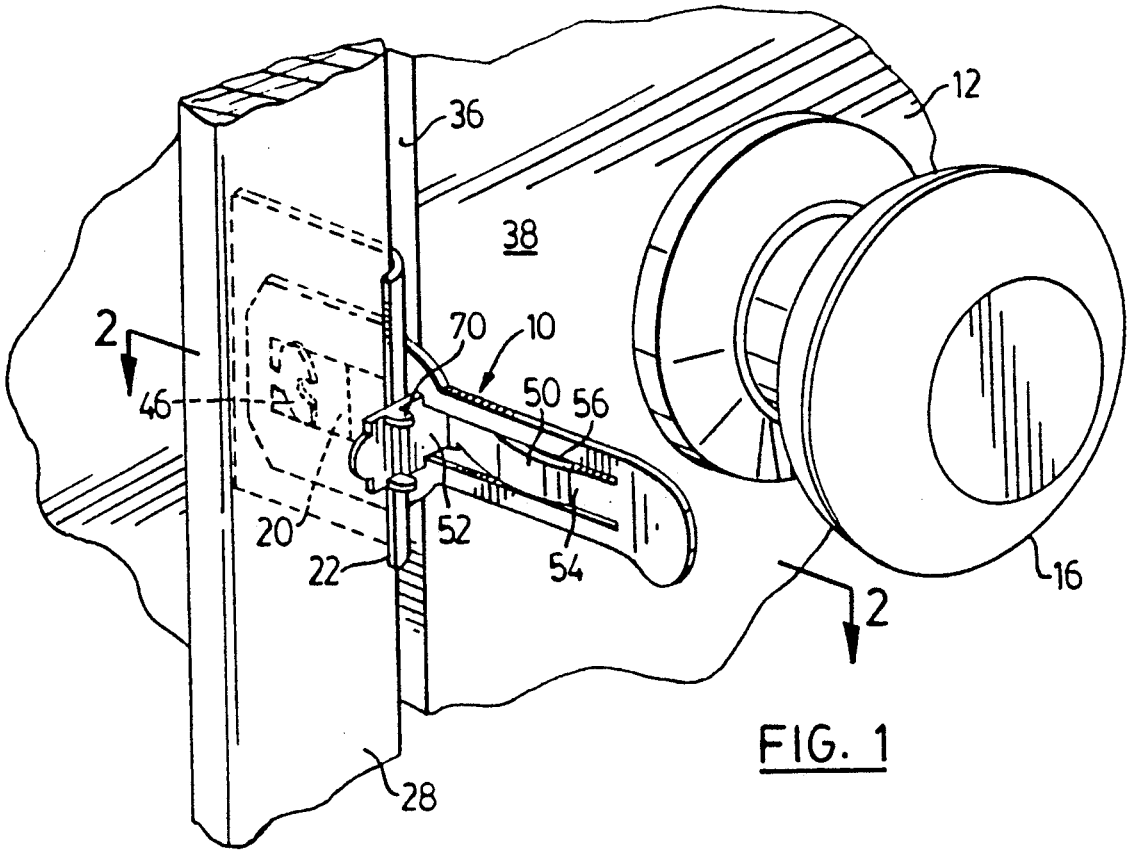
FIG. 1 is a fragmentary perspective view of a door and frame with a lock constructed in accordance with the invention attached in the locked position between the door and frame.
Figure 2:
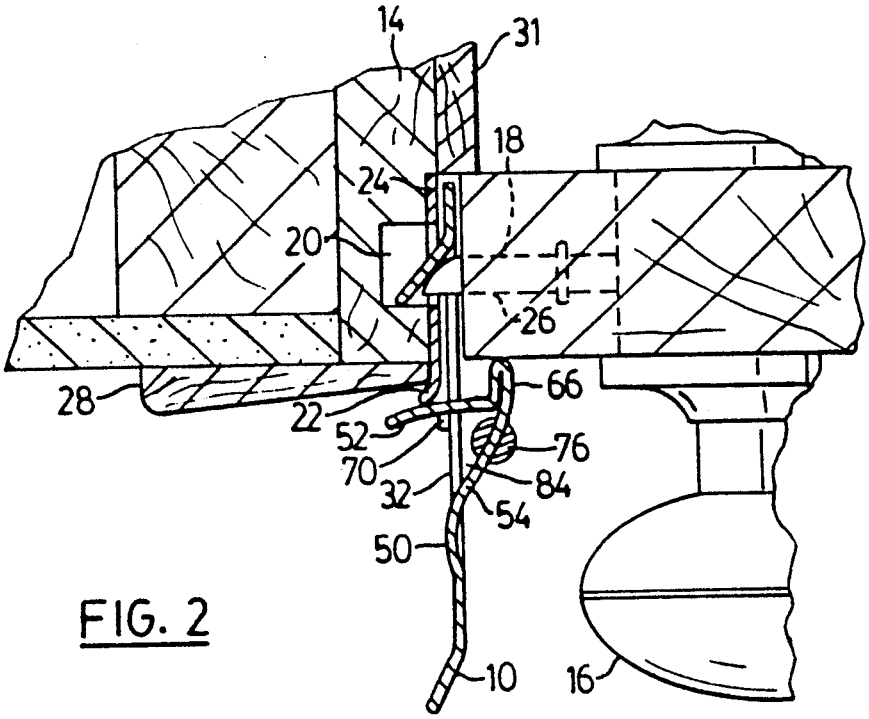
FIG. 2 is a cross-sectional view taken along the lines 2—2 of FIG. 1.

In FIGS. 1 and 2 there is shown a security lock 10 for a swinging door 12 used to open and close an opening defined by a door frame 14, only a portion of which is shown. Both the door 12 and the door frame 14 are constructed in the usual well known manner and they will not be described in detail as they form no part of the present invention. The door 12 is opened and closed with the use of a door knob 16 which operates a latch mechanism that includes a reciprocable bolt 18 movable into and out of a hole 20 in the door frame 14. The perimeter of the hole 20 is defined by a metal striker plate 22 which has a rectangular central opening therein. The opening 24 in the striker plate reinforces the hole cut in the door frame which is usually made of wood. As is well know, a flat side 26 of the bolt engages against one edge of the striker plate opening in order to keep the door closed.

The door frame may be covered by the usual trim piece 28 and a lip formed on one edge of the striker plate can extend around one edge of the trim piece as shown in FIGS. 1 and 2. The edge of the door is held in the closed position by means of the usual door jamb 31 which is firmly connected to the door frame.

Turning now to the security lock of the invention, the lock comprises an elongate lock member having a flat end section 30 at one end and a shank portion 32 at the opposite end thereof. The flat end section has a central opening 34 which can be generally rectangular. The end section 30 is reasonably thin so that it can be inserted between an edge 36 of the door and the door frame, as illustrated in FIGS. 1 and 2. In this inserted position, the shank portion 32 projects outwardly from one side 38 of the door. The shank portion permits the lock to be gripped and held even when the lock is in use and the door is closed.

Figure 3:
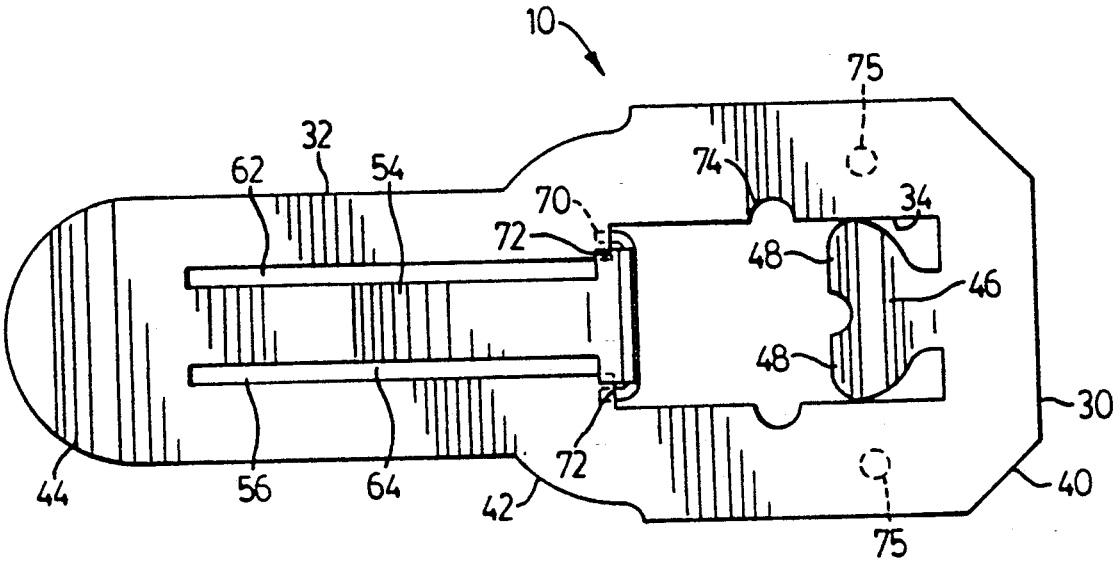
FIG. 3 is a side view of a security lock constructed in accordance with the invention.
Figure 4:
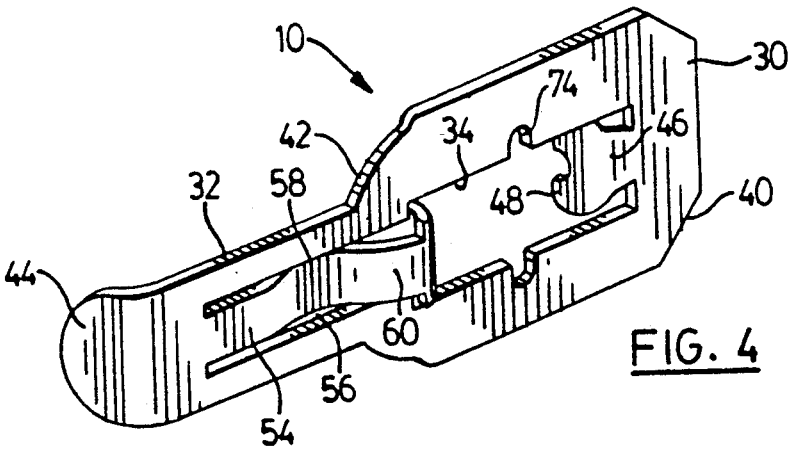
FIG. 4 is a perspective view of the lock of FIG. 3.

In the preferred embodiment of the lock 10 illustrated in FIGS. 3 and 4, the end section 30 has angled corners 40 at one end. The angled corners (which could also be rounded) help to prevent the lock from marking or scratching the door or door frame in use. A curved transition section 42 joins the end section 30 to the narrower shank portion 32. The shank portion preferably has a rounded end 44 which may form an obtuse angle with the remainder of the shank portion, if desired. The end section 30 may be provided with indentations 75 to locate holes that can be drilled for screws to attach the lock permanently to a door frame. These holes would be aligned with the standard screw holes in the striker plate. If desired, the present lock can be substituted in place of a striker plate or can be attached over a striker plate by screws that attach both the lock 10 and the striker plate.

Located adjacent the central opening 34 is a hook element 46 which is integrally connected to the flat end section 30. The rigid hook element 46 provides means for holding the flat end section between the door edge and the door frame 14 when the door is closed. As shown in FIG. 2, the hook element extends substantially at an acute angle to the plane of the flat end section 30 and towards the opposite end of the lock member. The hook element is constructed so as to project into the hole 20 in the door frame during use of the lock 10. In the preferred embodiment shown, the hook element is formed with a pair of spaced apart teeth 48 adapted to engage a side of the hole 20. The flat end section 30 extends a short distance past the hook element 46 in a direction away from the shank portion.

The lock also includes an integral tongue element 50 having one end thereof connected to the shank portion 32. This tongue element comprises a resilient door engaging member and it is biased to move from a first position shown in FIG. 7 of the drawings where the door 12 can be opened, to a second position shown in FIGS. 1 and 2 of the drawings, where the door is blocked and prevented from opening. The tongue element has a door engaging portion 52 which is biased by the spring action of the tongue element to move between the first and second positions. The preferred tongue element also includes a resilient stem portion 54, which is the portion integrally connected at one end to the shank portion. The stem portion is positioned in an elongate opening 56 formed centrally in the shank portion. In the first embodiment illustrated in FIGS. 1 to 4, the stem portion is S-shaped along its length having a first bend at 58 and a second bend in the opposite direction at 60. The door engaging portion 52 extends generally in a transverse direction relative to the adjacent end portion of the stem portion and relative to the flat end section 30.

Preferably the lock member 10 is formed from a single piece of spring steel in order to provide the necessary resiliency, strength and spring action. It will also be appreciated that the preferred lock member can be manufactured at a relatively low cost by being stamped from a single flat piece of metal. The hook element 46 is formed from a first metal section cut out to form the central opening 34 and trimmed and bent to form the desired shape for the hook element. The tongue element 50 is formed from a second metal section cut out from the elongate opening 56. As illustrated, the preferred elongate opening 56 extends right to the central opening 34 (see FIGS. 3 and 4). Preferably this second metal section is cut away so that there are clearance gaps 62 and 64 formed between the shank portion and the resilient stem portion 54 thus ensuring that the shank portion does not interfere with the spring action of the stem portion.

Figure 7:
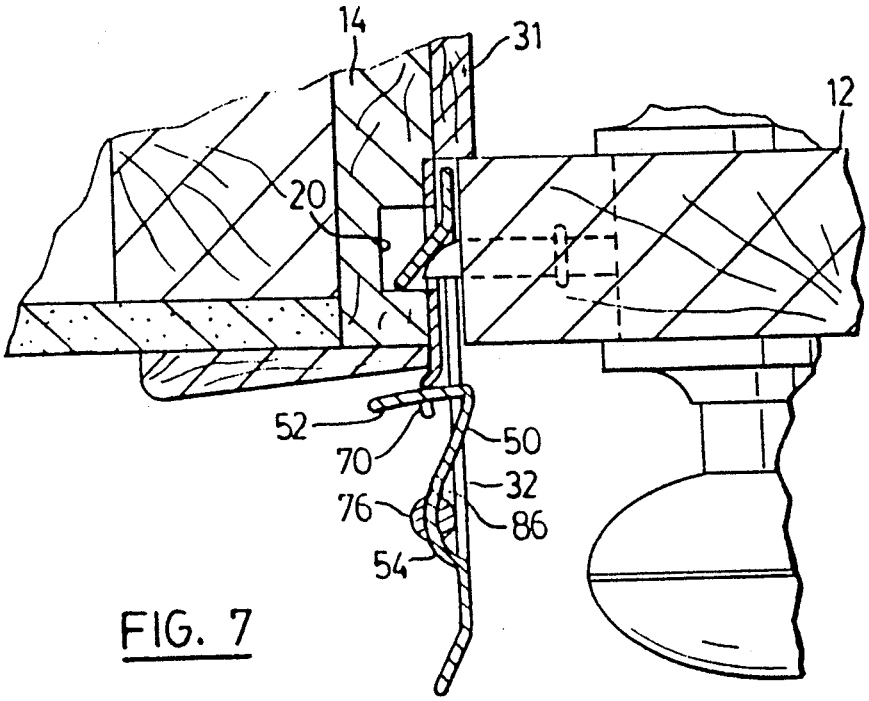
FIG. 7 is a cross-sectional view similar to that of FIG. 2 but showing the lock in the unlocked position, which position will permit the door to be opened.

In the preferred embodiment of the tongue element illustrated in FIG. 2, this element has an extension 66 formed where the stem portion 54 meets the door engaging portion 52. The extension 66 projects in use towards an adjacent side of the door and acts to present excessive play between the door and the door jamb 31. In the embodiment shown in FIG. 2, the extension is formed by means of a sharp U-bend in the tongue element where the stem portion meets the transversely extending section 52. It is, of course, possible to form the tongue element without the extension 66 as illustrated in FIGS. 3, 4 and 7.

In the illustrated preferred embodiment, the door engaging portion or transverse portion 52 of the tongue element has side edge tabs 70. These tabs prevent the tongue element from being pulled or pushed too far to one side of the lock. The tabs will engage corners 72 formed where the elongate opening 56 meets the central opening 34. The creation of these tabs creates semi-circular cut outs 74 on opposite sides of the opening 34.

Figure 5:
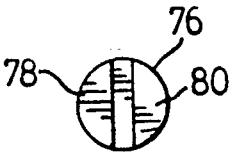
FIG. 5 is an end view of a two-prong pin that can be used in conjunction with the security lock.
Figure 6:
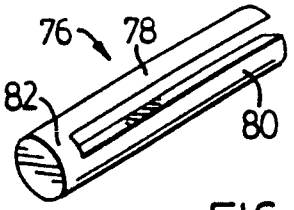
FIG. 6 is a perspective view of the pin of FIG. 5 showing the side thereof.
Figure 8:
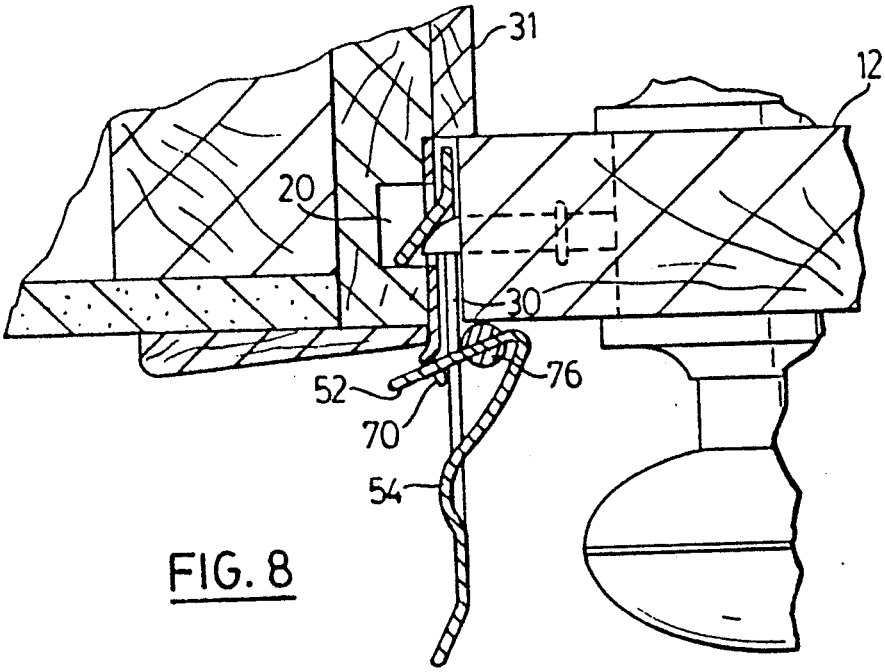
FIG. 8 is a cross-sectional view similar to that of FIG. 2 but showing the lock with a two-prong pin positioned to remove play between the door and the door jamb.

Preferably the security lock 10 of the invention is provided with a locking pin member 76 which is adapted to hold the tongue element in either the first position where the door can be opened (see FIG. 7) or the second position where the door is blocked (see FIG. 2). The preferred form of locking pin member is shown in FIGS. 5 and 6 and this member has two prongs 78 and 80 which are joined at one end 82. At least one of the two prongs is sufficiently small that it will fit in the opening 84 when the lock is in the position shown in FIG. 2 and it will fit in the opening 86 when the lock is in the unlocked position shown in FIG. 7. In addition to the functions of keeping the lock in either the unlocked position or the locked position, the illustrated pin member 76 can also be used to eliminate play between the door and the door jamb as shown in FIG. 8. Instead of using the extension 66, the two prong lock member 76 can be placed on the door engaging portion 52 at the illustrated location between the end section 30 and the stem portion 54. This maintains the door in the shut tight position as well as locked from the inside.

Figure 9:
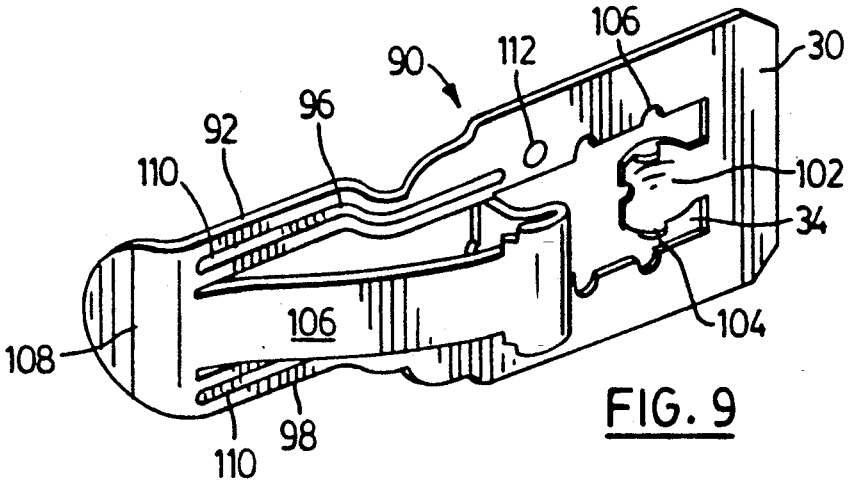
FIG. 9 is a perspective view of another embodiment of the invention wherein a shank portion of the lock is bent twice to provide a clearance space for a user's thumb or fingers.
Figure 10:
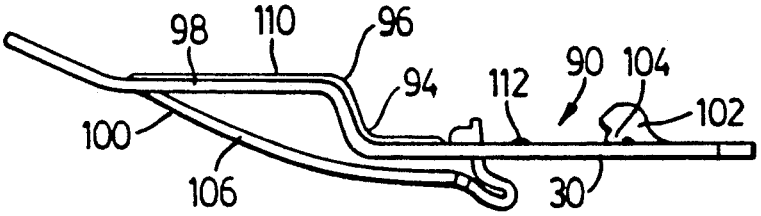
FIG. 10 is a side edge view of the embodiment shown in FIG. 9.

A second embodiment of a security lock constructed in accordance with the invention is shown in FIGS. 9 and 10 of the drawings. This security lock 90 is similar in many respects to the security lock shown in FIGS. 1 to 4 of the drawings and only those features of the lock 90 that differ from the first embodiment will now be described. In particular, in the lock 90 the shank portion 92 of the lock has a first bend 94 and a second bend 96, the two bends being in opposite directions. In this way there is a section 98 of the shank portion which is generally parallel to a plane defined by the flat end section 30 but is spaced therefrom. The two bends 94 and 96 are so positioned that a suitable clearance space 100 for the thumb or fingers of a user's hand is provided. This may make it easier for a user to grip the shank portion when installing or removing the security lock. The section 98 need not be perfectly parallel to the plane defined by end section 30 but can be at a small angle thereto if desired.

In the security lock of FIGS. 9 and 10, the rigid hook element 102 has its two teeth bent inwardly at their outer corners as shown. In addition, the outer edges of the hook element are preferably formed with tabs 104 which are bent inwardly towards the central opening 34. The formation of these tabs creates small recess in the flat end section 30. The hook element shown in FIGS. 9 and 10 is preferable for use in association with a Calimine or metal door frame. The tabs 104 engage the edge of the metal door frame located at the opening in the striker plate and thus the tabs and the curved shape of the hook element help hold the hook element in the opening in the door frame. The hook element 102 also extends substantially at an acute angle to the plane of the flat end section.

In this second embodiment, the resilient stem portion 106 of the tongue element has a different shape than the stem portion of the first embodiment. The stem portion 106 is gently curved in one direction from its distal end 108 to the door engaging end. In addition, the entire shank portion of this security lock is strengthened by the use of elongate ribs or channels 110 of which there are two located on opposite sides of the tongue element. These ribs or channels are bent into the shank portion in order to increase the strength thereof and to prevent the shank portion from being easily bent out of shape.

Finally, it will be noted that the second embodiment is formed with two reasonably large dimples 112, these being located in the flat end section 30 on opposite sides of the rectangular opening. The dimples 112 act to provide a better engagement between the flat end section 30 and the door frame, thus making it harder to dislodge this security lock.

Figure 11:
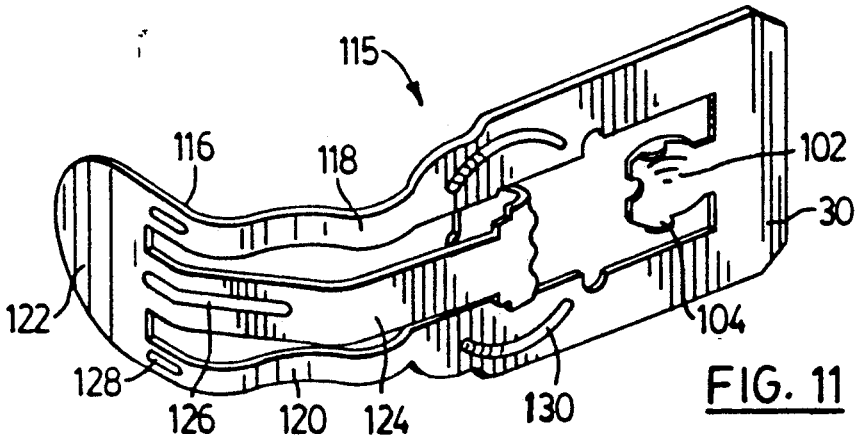
FIG. 11 is a perspective view of a further embodiment of the invention which has a resilient shank portion which is bent in order to move the door engaging portion of the tongue to a position where the door can be opened.
Figure 12:
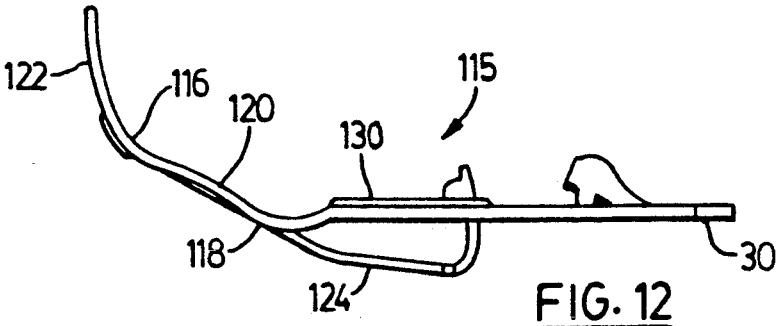
FIG. 12 is a side edge view of the embodiment shown in FIG. 11.

A third embodiment of the security lock of the invention is shown in FIGS. 11 and 12. This lock 115 is similar to the second embodiment shown in FIGS. 9 and 10 except for the differences to be described herein. In particular, this lock has a hook element 102 which is the same as that in the second embodiment. However, the shank portion 116 forms a substantial bend and extends some distance from the plane formed by flat end section 30. Thus, the shank portion 116 curves outwardly away from the door so as not to interfere with the operation of the door. In the illustrated embodiment, the shank portion is bent at 118 and from this bend there extends a substantially straight section 120. There is also a slightly bent end portion 122.

In this third embodiment, the tongue element 124 is relatively rigid while the shank portion of the lock is made resilient so as to provide a spring action. Thus, the door engaging portion of the tongue element is biased by the spring action of the shank portion to move from a first position wherein an adjacent door can be opened or closed to the second position (shown in FIG. 12) where the door is blocked and prevented from opening. In order to increase the rigidity of the stem portion, it can be provided with a groove or rib 126 along a portion thereof, in particular in the region where the stem portion connects to the shank portion of the lock. If desired, the shank portion can also be made rigid at certain locations by means of grooves or ribs 128 stamped into the metal. The transition area between the flat end section 30 and the shank portion can be made more rigid by means of stamped grooves 130.

Thus, in the embodiment of FIGS. 11 and 12 the split section of the shank portion is designed to bend under an applied force in the region indicated at 120 and also at 118.

Figure 13:
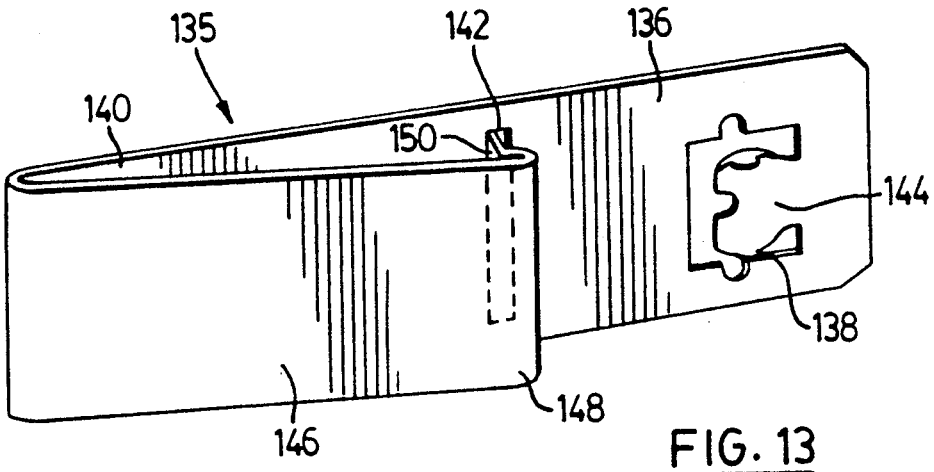
FIG. 13 is a perspective view of still another embodiment of the invention wherein a metal strip forming the shank portion is bent over to form the tongue element.
Figure 14:
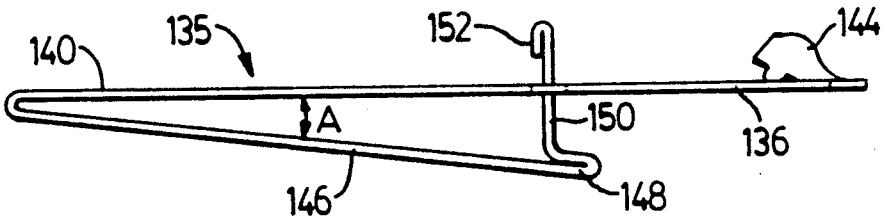
FIG. 14 is a side edge view of the embodiment shown in FIG. 13.

Another version of the present security lock is shown in FIGS. 13 and 14 of the drawings. This security lock 135 comprises an elongate lock member made from a single strip of suitable metal, preferably spring steel. This lock member has a flat end section 136 with a central opening 138. This lock member also has a shank portion 140 and located approximately where the shank portion meets the flat end section is an elongate transverse slot 142. The shank portion is connected to the flat end section 136 by short connecting portions at each end of the slot. As in the other embodiments, there is a hook element 144 connected to the flat end section. An integral tongue element 146 has one end thereof connected to the end of the shank portion. The tongue element 146 has a door engaging portion 148 which is biased by spring action of the tongue element to move from a first position where the door can be opened or closed to a second position where the door is blocked and prevented from opening (the second position being shown in the drawings). As illustrated, the tongue element including the door engaging member and the shank portion are formed from a single strip of metal that has been bent over at a central location so that the door engaging member forms a small acute angle A with the shank portion. Tongue element 146 in this embodiment has the same width as the shank portion. However, there is a relatively short end portion 150 which has a narrower width so that it can pass through the slot 142. This end portion is held in the slot by having its end bent over at 152 The end piece 152 can be made sufficiently thick, if desired, so that it cannot be pulled out of the slot 142. This helps to ensure that the door cannot be forced open when the security lock 135 is in place. The embodiment of FIGS. 13 and 14 is advantageous in that it uses the full width of the security lock to provide a very strong tongue element which cannot readily be bent out of shape or broken in order to open the door.

It will be appreciated that various modifications and changes can be made to the security lock as described herein without departing from the spirit and scope of this invention. For example, the lock can be made from metals other than spring steel, provided the metal chosen has the necessary strength and resiliency. Also, instead of forming the extension 66 in the manner shown in FIG. 2, the extension could be formed by welding an extension member at the junction between the transverse portion 52 and the stem portion 54.

It will also be understood by those skilled in the art that the lock 10 of the invention could be equipped with an electronic or electric warning device to indicate to the user that an attempt is being made to open the door. For example, an electrical contact located on a door engaging portion 52 and connected to a buzzer or other alarm could be used for this purpose. The contact would be closed by the side of the door engaging or pressing against the contact when someone attempts to open the door.

I therefore claim:

1. A security lock for a door used to open and close an opening defined by a door frame, said door having a reciprocable bolt movable into and out of a hole in said door frame, said lock comprising an elongate lock member having a flat end section with a central opening at one end of the lock member and a shank portion at the opposite end thereof, said lock member being formed from a single piece of spring steel, said flat end section being insertable between an edge of the door and said door frame with the shank portion projecting outwardly from one side of the door, a rigid hook element connected to said first end section and located adjacent said central opening so as to project into said hole in said door frame during use of the lock, said hook element extending substantially at an acute angle to the plane of said flat end section and towards said opposite end of the lock member, and an integral tongue element having one end thereof connected to said shank portion, said tongue element having a door engaging portion biased by spring action of the tongue element to move from the first position wherein said door can be opened or closed to a second position where said door is blocked and prevented from opening.

2. A security lock according to claim 1 wherein said tongue element includes a resilient stem portion integrally connected at one end thereof to said shank portion, said stem portion being positioned in an elongate opening formed centrally in said shank portion.

3. A security lock according to claim 2 wherein said stem portion is curved along its length and is connected at its distal end to said door engaging portion, the latter portion extending generally in a transverse direction relative to said flat end section.

4. A security lock according to claim 2 including an elongate locking pin member adapted to hold said tongue element in the first portion where said door can be opened or closed, said pin member having a single elongate slot only and short transverse dimensions so as to permit said pin member to be mounted on said tongue element.

5. A security lock according to claim 1 including an elongate two-prong locking pin member adapted to hold said tongue element in either the first position where said door can be opened or closed or said second position where said door is blocked, said pin member having a single elongate slot only formed by the two prongs and short transverse dimensions so as to permit said pin member to be mounted on said tongue element.

6. A security lock according to claim 1 wherein said hook element is formed with a pair of spaced apart teeth adapted to engage a side of said hole in the door frame.

7. A security lock for a door used to open and close an opening defined by a door frame, said door having a reciprocable bolt movable into and out of a hole in said door frame, said lock comprising an elongate lock member having a flat end section with a central opening at one end of the lock member and a shank portion at the opposite end thereof, said flat end section being insertable between an edge of the door and said door frame with the shank portion projecting outwardly from one side of the door, a hook element connected to said flat end section and located adjacent said central opening so as to project into said hole in said door frame during use of the lock, and an integral tongue element having one end thereof connected to said shank portion, said tongue element having a door engaging portion biased by spring action of the tongue element to move from the first position wherein said door can be opened or closed to a second position where said door is blocked and prevented from opening, wherein said tongue element includes a resilient stem portion integrally connected at one end thereof to said shank portion, said stem portion being positioned in an elongate opening formed centrally in said shank portion, and wherein said lock member is stamped from a single flat piece of metal, said hook element is formed from a first metal section cut out to form said central opening, and said tongue element is formed from a second metal section cut out from said elongate opening in said shank portion, which elongate opening extends to said central opening.

8. A security lock according to claim 7 wherein said tongue element has an extension formed wherein said stem portion meets said door engaging portion, said extension projecting in use towards an adjacent side of the door and acting to prevent excessive play between the door and a door jam.

9. A security lock according to claim 8 wherein said extension is formed by forming a sharp U-bend in the tongue element where said stem portion meets said door engaging portion.

10. A security lock for a door used to open and close an opening defined by a door frame, said door including a latch mechanism with a reciprocable bolt movable into and out of a hole in said door frame, said lock comprising a lock member having a flat end section with an opening therein at one end and a shank portion at the opposite end thereof, said lock member being stamped from a single flat piece of spring steel, said flat end section being insertable between one edge of the door and said door frame, a rigid hook element for holding said flat end section between said door edge and said door frame when said door is closed, said hook element being connected to said flat end section, and located adjacent said opening, said hook element extending substantially at an acute angle to the plane of said flat end section and towards said opposite end of the lock member, and a resilient door engaging member mounted on said shank portion and biased to move from a first position where said door can be opened or closed to a second position where said door is blocked and prevented from opening, wherein said hook element is formed from a first metal section cut out to form said opening in said end section and said door engaging member is formed from a second metal section cut out from an elongate opening in said shank portion.

11. A security lock according to claim 10 including an elongate locking pin member adapted to hold said door engaging member in either the first position or the second position said pin member having a single elongate slot only.

12. A security lock according to claim 10 wherein said door engaging member includes a resilient stem portion integrally connected at one end thereof to said, shank portion, said stem portion being positioned in said elongate opening formed centrally in said shank portion.

13. A security lock according to claim 10 wherein said door engaging member includes a resilient stem portion connected at one end thereof to said shank portion and a door engaging end portion, and said stem portion is curved along its length and is connected at its distal end to said door engaging portion, the latter portion extending generally in a transverse direction relative to said flat end section.

14. A security lock according to claim 11 wherein said pin member has two parallel prongs only, which prongs are joined together at one end of the pin member.

15. A security lock according to claim 10 wherein said door engaging member has an extension formed at one end, said extension projecting in use towards an adjacent side of the door and acting to prevent excessive play between the door and a door jamb.

16. A security lock according to claim 10 wherein said shank portion has two bends formed therein that bend in opposite directions, whereby a section of said shank portion is generally parallel to or at a small angle to a plane defined by said flat end section.

17. A security lock according to claim 10 wherein said door engaging member and said shank portion are formed from a single strip of metal that has been bent over at a central location so that said door engaging member forms a small acute angle with said shank portion.

18. A security lock according to claim 17 wherein said door engaging member has a relatively short end portion and a longer stem portion and said short end portion extends through a slot formed in said lock member at the juncture of said flat end section and said shank portion and is held therein.

19. A security lock for a door used to open and close an opening defined by a door frame, said door having a reciprocable bolt movable into and out of a hole in said door frame, said lock comprising an elongate lock member having a flat end section with a central opening at one end of the lock member and a shank portion at the opposite end thereof, said lock member being stamped from a single flat piece of metal, said flat end section being insertable between an edge of the door and said door frame with the shank portion projecting outwardly from one side of the door, a rigid hook element connected to said flat end section and located adjacent said central opening so as to project into said hole in said door frame during use of said lock, said flat end section extending a short distance past said hook element in a direction away from said shank portion, and an integral tongue element having a door engaging portion biased by spring action of one of said tongue element or said shank portion to move from a first position wherein said door can be opened or closed to a second position where said door is blocked and prevented from opening, wherein said tongue element includes a resilient stem portion integrally connected at one end thereof to said shank portion, said stem portion being positioned in an elongate opening formed centrally in said shank portion, and wherein said hook element is formed from a first metal section cut out to form said central opening, and said tongue element is formed from a second metal section cut out from said elongate opening in said shank portion, which elongate opening extends to said central opening.

* * * * *